US005259583A

United States Patent [19]

Meredith

[11] Patent Number: 5,259,583

[45] Date of Patent: Nov. 9, 1993

[54] HUNG ART HOLDING DEVICE

[76] Inventor: Phyllis F. Meredith, R.R. #2, Iola, Kans. 66749

[21] Appl. No.: 912,284

[22] Filed: Jul. 13, 1992

[51] Int. Cl.[5] ..... A47G 1/16

[52] U.S. Cl. ..... 248/494; 248/475.1

[58] Field of Search ..... 248/475.1, 489, 493, 248/494, 497, 498, 499, 466; 40/152.1, 153; 24/300, 301

[56] References Cited

U.S. PATENT DOCUMENTS

| | | | |
|---|---|---|---|
| 374,386 | 12/1887 | Winne . | |
| 551,256 | 12/1895 | Brown . | |
| 801,468 | 10/1905 | Lynch . | |
| 2,771,259 | 11/1956 | Laystrom | 248/489 |
| 2,879,018 | 3/1959 | Pence | 248/494 |
| 3,290,743 | 12/1966 | Hanson . | |
| 3,650,502 | 3/1972 | Langhi | 248/220.4 |
| 4,133,080 | 1/1979 | Kuk | 24/73 |
| 4,296,946 | 10/1981 | Larre et al. | 281/45 |
| 4,407,523 | 10/1983 | Campione | 248/453 X |
| 4,432,121 | 2/1984 | Dupre | 24/300 X |
| 4,512,603 | 4/1985 | Williams | 248/451 X |
| 5,054,736 | 10/1991 | Champoux | 248/451 X |

*Primary Examiner*—J. Franklin Foss
*Attorney, Agent, or Firm*—Charles W. Alworth

[57] ABSTRACT

This invention relates to a system for restraining the motion, caused by wind, of hung two dimensional art work when displayed at outdoor exhibitions and fairs. The system consists of a back plane upon which the art work is displayed and a quickly releasable restraining device which easily couples and uncouples to the back plane. The releasable restraining device being almost indiscernible from the art work.

6 Claims, 2 Drawing Sheets

HUNG ART HOLDING DEVICE

FIELD OF THE INVENTION

This invention relates to the display of hung two-dimensional art work at open air art fairs or exhibitions. In particular, this invention inhibits movement of the displayed art work which can be caused by wind.

1. Background of the Invention

Two-dimensional artists often attend open air art fairs or exhibitions where they can display and sell their artistic endeavors. These artists usually travel a circuit of fairs and carry their wares and display equipment with them. A major problem at such open air fairs is wind which can induce two-dimensional art to move violently back and forth, thus, damaging the frame or the art contained within the frame. The effect of the wind could be lessened by tying such art work to a support with string or a like material but this sort of restraining system would detract from the displayed work. Furthermore, sales of the art would be slowed while the string or like restraint was undone. Thus, the applicant, an artist, has devised a simple releasable hung art holding device.

Accordingly, it is an object of the present invention to provide a simple procedure to hold hung art work in place during gusts of wind, to be easily removed, to minimize detraction from the displayed art, and to adapt readily to various sized picture frames of varying thickness or to matted art.

It is a further object of the present invention to provide a simple inexpensive technique that will adapt readily to the various types of support media used at open air art fairs or exhibitions.

2. Prior Art

Banded support systems are well known in the art. The closest prior art known to the Applicant includes U.S. Pat. Nos. 374,386; 551,256; 801,468; 3,290,743; 4,133,080; 4,296,946; 4,512,603; and 5,054,736. These prior art banded systems are designed to hold a book open; to hold a book in a fixed stand; to hold a single sheet of paper in a fixed stand; or to hold a tablecloth horizontally on a table.

U.S. Pat. No. 374,386 (Winne) discloses a device to secure the pages of a book in the open position. The banding element attaches to wire supports slipped onto the cover of the book in question; however, this system is designed to be integral to the book itself and not be in communication with an external support system.

U.S. Pat. No. 551,256 (Brown) discloses a book rest in which the pages of the book are held open in a like manner as to the Winne disclosure (U.S. Pat. No. 374,386); except that the banding device is in communication with an external support system. This banding system is limited to use only with the external support system and its associated V-grove.

U.S. Pat. No. 801-468 (Lynch) discloses a copy holder. There are two banding devices disclosed in this invention. The first such device is fixed to the holder and is used to support the sheet of paper that is being copied. The second such device is used as a movable pointer so that the copyist can keep track of the line. The invention does not disclose how these bands are attached to the holder; but a person skilled in the art could suppose that a technique similar to that disclosed in Winne (U.S. Pat. No. 374,386) could be employed.

U.S. Pat. No. 3,290,743 (Hanson) discloses an adjustable banding device used to hold down table cloths at a picnic. The banding device is attached to metal spring clips which are then clipped to the table top. These clips are substantially similar to the spring clips that are used by draftsmen to hold drawings in place on drafting tables.

U.S. Pat. No. 4,133,080 (Kuk) discloses a text book holder which like Hanson (U.S. Pat. No. 3,290,743) uses a spring clip to hold the banding device to the cover of a loose-leaf notebook.

U.S. Pat. No. 4,296,946 (Larre) discloses yet another form of book support. The banding device in this invention is used to hold the pages of a book open. The device is fixed so that it crosses the stand at its midpoint. This invention discloses a method by which the tension of the band may be adjusted through the use of a bead chain which slips into a V-notch. This invention allows for easy adjustment for varying thicknesses of text book material.

U.S. Pat. No. 4,512,603 (Williams) discloses yet another form of book support which uses two banding devices. One is fixed at the midpoint of the support system and runs vertically to hold the book inside the restraint, whereas the second fixed system runs horizontally and is designed to hold the pages open.

U.S. Pat. No. 5,054,736 (Champoux) discloses both another book support system and a writing stand. The banding device is again used to hold a book open. The disclosure broaches the method of attachment to the edges of the support board but does not fully explain the method. One of ordinary skill in the art would suppose that some sort of metal hook would be attached to the band and then be slipped into the V-grove on the edge of the support board.

The banded devices used in conjunction with reading or writing materials are all designed to hold a sheet in place or a book open and must be in communication with the cover of the book or with the support system. The devices in general will not readily respond to changes in both thickness and size. The table cloth hold down system requires a spring clip to the edge of the table which implies a flat surface and thus would not work with a non-planar picture frame. Furthermore, all of the prior art references will not work with varying types of support systems—that is the back plane must be specifically shaped for the banded device to stay in place and thus hold down or support the object in question.

SUMMARY OF THE INVENTION

The hung art holding device uses a back plane support system with multiple openings (such as expanded aluminum or expanded steel) in conjunction with spreading couplings (such as a "toggle bolt") which are attached to both ends of a resilient material (such as an "elastic band") thus forming the releasable restraining device. The two dimensional art work is then vertically "hung" from the back plane support. One of the couplers is inserted through a convenient opening on one side of the art near the bottom; the releasable restraint is then placed across the art; and the remaining coupler is placed in another convenient opening on the other side of the art work. The color of the releasable restraint would be matched to the background of the art work that it is restraining and thus becomes almost indistinguishable.

DESCRIPTION OF THE PREFERRED EMBODIMENTS

Figure 1:
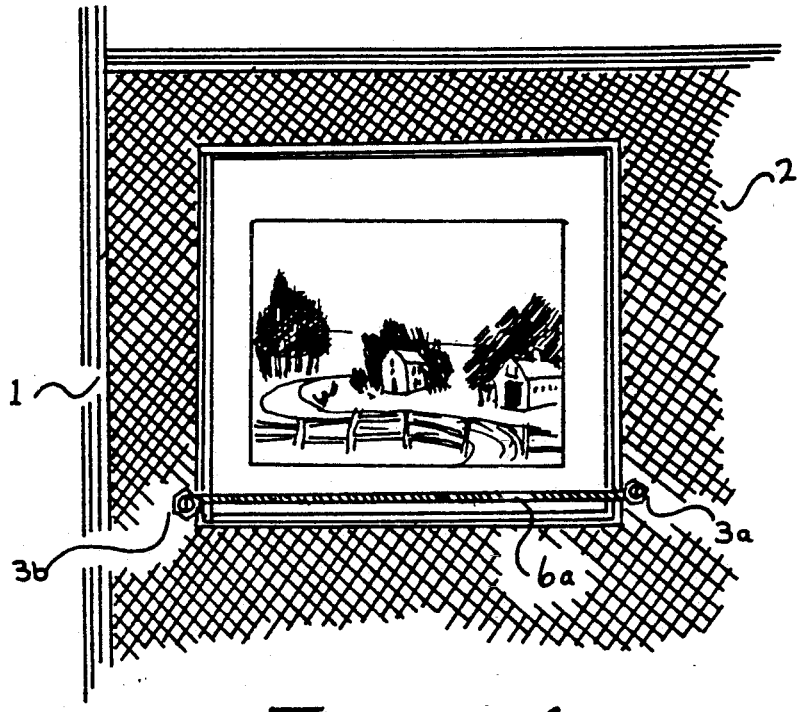
FIG. 1 is a front view of the invention showing the "hung" two dimensional art with the releasable restraint barely discernible along the bottom edge of the frame.
Figure 2:
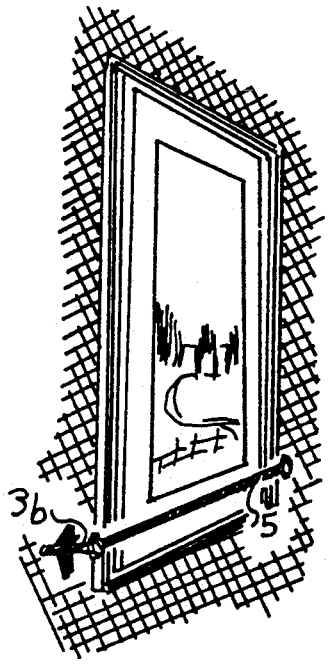
FIG. 2 a side view of the releasable restraining device and the preferred coupling device. This view also illustrates how a picture frame is "hung" on the support system.
Figure 3:
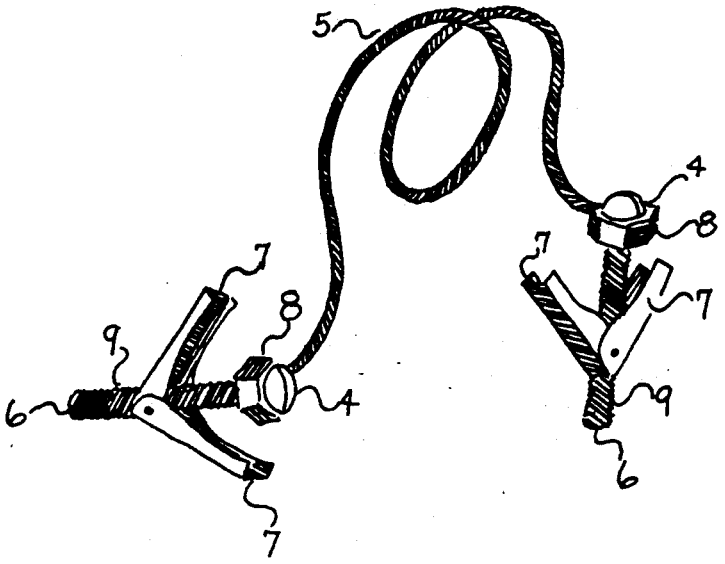
FIG. 3 shows a preferred embodiment of the invention—the elastic band attached at both ends to a "toggle bolt".
Figure 4:
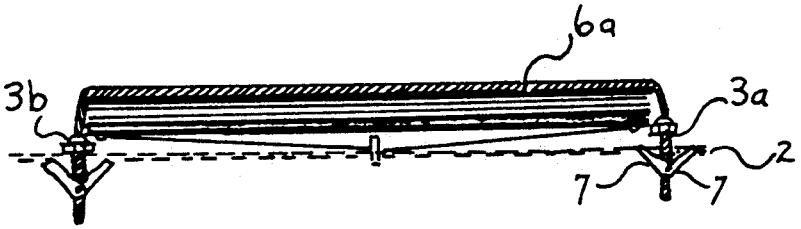
FIG. 4 shows an end view of the releasable restraint illustrating how the coupler operates in conjunction with the restraint, the art, and the back plane support system.

Referring now to FIGS. 1–4, the preferred embodiment back plane support system (2) of expanded aluminum or steel is shown attached to a display frame (1) which in turn is set in a vertical position on the ground (or floor). The display frame (1) is not a portion of this invention and would be similar in design to a frame that is used for portable chalk-boards and the like. The back plane support system could easily be made of "pegboard" or "hailscreen" sometimes called "hardware cloth." FIG. 1 shows the preferred mounting for a "hung" picture frame. The scheme could easily be modified to mount matted art work by placing additional retraining devices across the mat as required.

The form of this invention generally includes an adjustable releasable restraint, such as a fabric coated elastic band (5) which terminates at each end in a coupling device (6). Each such coupling device is identical and in the preferred embodiment such coupler is a simple "toggle bolt" readily obtainable at any hardware store. The size of the preferred coupling device is selected so that when the fingers (7) are compressed, they will readily pass through the openings in the back plane support (2).

In the preferred embodiment, the elastic band is tied around the bolt (9) of the toggle bolt by any convenient means such as an ordinary knot known as a "square knot". Then to assure further security, between the restraining device (6) and the elastic band (5), a standard machine nut (8) is tightened against the elastic band (5) to retain the band between the head of the toggle bolt (4) and the machine nut (8). Optionally, epoxy resin sealant or other such means may be used to prevent the elastic band from separating from the head of the toggle bolt.

Once the picture frame is "hung" on the back plane support system installation of the holding device is quite straightforward. One of the holding device restraints (6) is inserted through a convenient opening (3*b*) on the back plane (2) near the bottom side of the picture frame. The fingers (7) of the coupling device would spring open such as a normal toggle bolt would do and provide underpinning for the elastic support band (5) against the back plane (2). The releasable restraint is then placed across the bottom of the frame and the other coupling device is pushed through another convenient opening (3*a*). The fingers (7) of this device spring open and provide underpinning on the other side of the elastic support band. The releasable restraint now holds the frame securely against the back plane support (2), thus preventing damage to the "hung" art in the face of wind. The effect is pleasing to the eye as the picture frame now appears in a similar manner as it would when mounted on a wall in a person's home.

Removal of the device is very simple. The coupling device fingers (7) are squeezed together at the same time withdrawing the coupler from the opening (3). The picture frame is now free to be dismounted from the display back plane support system.

The releasable restraint system would operate in a similar manner for matted two dimensional art. In this case, two such restraint devices would be used. The devices would be placed across the matted picture at top and bottom running in a horizontal direction. Alternatively, the devices could be placed on either side of the matted picture running in a vertical direction. Additional such restraints could be used as needed.

It should be realized that almost any form of flexible material could be utilized for the restraining device. As explained above, the preferred form is an elastic band (fabric covered for ease of dyeing); however, a flexible piece of spring steel suitably attached to the coupling devices could be used. The spring steel could be flat or rounded. Similarly a flexible piece of suitably colored plastic or wood could be used. The advantage of the fabric coated elastic band (readily made of Lycra TM) comes about because it will easily adjust to almost any size of "hung" art work. Furthermore, the fabric coated elastic band can be dyed to match the art work that needs to be restrained.

It should also be realized that almost any type of coupling device could be utilized. For example, a simple hook could be used. Such a hook could damage the hung (or supported) art. The pleasing effect, to the observer's eye, of an indiscernible hold down device would not be be as easy to obtain. The coupling device could be manufactured to duplicate the action of a toggle bolt but have the added feature of a mechanical system to retract the fingers from the front surface of the support plane.

It should also be realized to anybody skilled in the art that the back plane could easily be made of peg board or hailscreen. All that is needed are a series of openings in the support plane that can readily be chosen to accommodate the two dimensional art work.

Different sizes and thicknesses of two dimensional art work can be accommodated by a series of premanufactured releasable restraint devices of varying lengths. The user would then select the appropriate device for his or her two dimensional art object.

It should be recognized that the foregoing description and drawings are illustrative of the invention and are provided for explanation and understanding only. The scope of the invention should not be limited by the foregoing description and drawings, but should be determined by the claims that follow.

I claim:

1. A hung art holding device for quick removable attachment of art work through selected openings of an apertured back plane having a plurality of openings, upon which art work may be placed or hung comprising:

(a) a means for releasably restraining said art work against said apertured back plane; and, (b) means for coupling said releasable retraining means to said openings in said apertured back plane, where said coupling means comprises a "toggle-bolt."

2. The hung art holding device as recited in claim 1 where said means for releasably restraining said art work is a resilient fabric covered elastic member, said resilient fabric covered elastic member being attached to said coupling means on opposing transverse ends thereof.

3. The hung art holding device as recited in claim 1 where said means for releasably restraining said art work is a flexible flat spring steel member, said flexible flat spring steel member being attached to said coupling means on opposing transverse ends thereof.

4. The hung art holding device as recited in claim 1 where said means for releasably restraining said art work is a flexible rounded spring steel member said flexible rounded spring steel member being attached to said coupling means on opposing transverse ends thereof.

5. The hung art holding device as recited in claim 1 where said means for releasably restraining said art work is a flexible plastic member said flexible plastic member being attached to said coupling means on opposing transverse ends thereof.

6. The hung art holding device as recited in claim 1 where said means for releasably restraining said art work is a flexible wooden member, said flexible wooden member being attached to said coupling means on opposing transverse ends thereof.

* * * * *